United States Patent [19]

Chakrabarti et al.

[11] Patent Number: 5,055,257

[45] **Date of Patent: * Oct. 8, 1991**

[54] SUPERPLASTIC ALUMINUM PRODUCTS AND ALLOYS

[75] Inventors: Dhruba J. Chakrabarti; James T. Staley, both of Murrysville; Stephen F. Baumann, Penn Hills; Ralph R. Sawtell, Monroeville; Philip E. Bretz, Murrysville; Craig L. Jensen, Pittsburgh, all of Pa.

[73] Assignee: Aluminum Company of America, Pittsburgh, Pa.

[ * ] Notice: The portion of the term of this patent subsequent to Aug. 25, 2004 has been disclaimed.

[21] Appl. No.: 414,872

[22] Filed: Sep. 29, 1989

Related U.S. Application Data

[63] Continuation-in-part of Ser. No. 85,851, Aug. 14, 1987, which is a continuation-in-part of Ser. No. 841,648, Mar. 20, 1986, Pat. No. 4,689,090.

[51] Int. Cl.[5] ..... C22C 21/16; C22C 21/06

[52] U.S. Cl. ..... 420/902; 148/11.5 A; 148/438; 148/439

[58] Field of Search ..... 420/902; 148/11.5 A, 148/437–440

[56] References Cited

U.S. PATENT DOCUMENTS

| | | | |
|---|---|---|---|
| 3,619,181 | 11/1971 | Willey | 75/138 |
| 3,847,681 | 11/1974 | Waldman et al. | 148/11.5 A |
| 3,876,474 | 4/1975 | Watts et al. | 148/32 |
| 3,997,369 | 12/1976 | Grimes et al. | 148/11.5 R |
| 4,045,986 | 9/1977 | Laycock et al. | 72/60 |
| 4,092,181 | 5/1978 | Paton et al. | 148/12.7 A |
| 4,181,000 | 1/1980 | Hamilton et al. | 72/60 |
| 4,516,419 | 5/1985 | Agrawal | 72/60 |
| 4,689,090 | 8/1987 | Sawtell et al. | 420/902 |
| 4,874,440 | 10/1989 | Sawtell et al. | 148/437 |

OTHER PUBLICATIONS

"Influence of Fine Transition-Metal Particles and Grain Structure on Fracture Behavior of Al-Cu-Mg Alloys", A. M. Drits et al., Izvestiya Akademii Nauk SSSR, *Metally,* No. 4, pp. 150–155, 1985.

"Superplasticity of Alloy of the Al-Cu-Mg System with Additions of Transition Metals", A. M. Diskin et al., *Sov. Non-Ferrous Met. Res.,* 1986, 14(6), 499–500.

*Primary Examiner*—R. Dean
*Assistant Examiner*—Robert R. Koehler
*Attorney, Agent, or Firm*—Carl R. Lippert

[57] ABSTRACT

Superplastic forming of aluminum work stock is improved by including therein about 0.05% to about 10% or 15% scandium together with up to 0.2 or 0.25% zirconium. In preferred practices, soluble elements such as magnesium are also included in the aluminum alloy. One or more of the elements from the group of scandium, yttrium, gadolinium, holminum, dysprosium, erbium, ytterbium, lutetium, and terbium, may be included in addition to or in lieu of scandium. Heat treatable aluminum alloys such as 7XXX alloys and 2XXX alloys can be made superplastic by including scandium and zirconium to provide very high strength in superplastically formed products.

30 Claims, 1 Drawing Sheet

SUPERPLASTIC ALUMINUM PRODUCTS AND ALLOYS

CROSS-REFERENCE TO RELATED APPLICATIONS

This application is a continuation-in-part of U.S. application Ser. No. 085,851, filed Aug. 14, 1987 which, in turn, was a continuation-in-part of application Ser. No. 841,648, filed Mar. 20, 1986, now U.S. Pat. No. 4,689,090.

FIELD OF INVENTION

This invention relates to superplastic forming of aluminum alloys and to special aluminum alloys and products adapted to superplastic forming at elevated temperature.

BACKGROUND OF THE INVENTION

Superplastic forming of metals is well known in the art whereby complex shapes are formed from metal at elevated temperature utilizing the superplastic forming characteristics of the metal to avoid tearing and other problems in forming complex shapes. Superplastic forming can be viewed as an accelerated form of high-temperature creep and occurs much like sagging or creep forming. In the case of aluminum alloys, superplastic forming is normally performed at temperatures above 700° F., typically in the range of about 900° to 1000° F. or a little higher. At this temperature, the metal creeps and can be moved by shaping operations at relatively low stress levels, the stress at which the metal starts to move easily or flow being referred to as the "flow stress". Superplastic forming is recognized as being able to produce intricate forms or shapes from sheet metal and offers the promise of cost savings. For instance, an airplane member previously made by stamping several parts from sheet and then joining the separate parts together into a more complex shape can be formed from a single piece of metal by superplastic forming techniques. Alternatively, the part may be superplastically formed by the forging process whereby the starting stock may be either an ingot or a semi-fabricated, hot worked product. However, the superplastic forming techniques themselves are time-consuming in that like any form of creep forming, the metal flowing operation proceeds relatively slowly in comparison with high-speed press forming. Substantial cost-savings and benefits could be realized if the aluminum alloy to be superplastically formed could be made to flow faster at a given temperature or be superplastically formed at a lower temperature or both without tearing or rupturing.

There are a number of approaches taken to enhance superplastic forming. Some of these approaches are directed to manipulations in the superplastic forming operation to enhance that operation or alleviate problems therein largely by controlling the flow of the metal during forming. Examples of such are shown in U.S. Pat. Nos. 3,997,369, 4,045,986, 4,181,000, and 4,516,419, all incorporated herein by reference. Another approach is directed to the metal to be superplastically formed. It has long been recognized that fine grain size enhances forming operations including superplastic forming operations. Some examples of efforts to achieve fine grain size are shown in U.S. Pat. Nos. 3,847,681 and 4,092,181. One approach to achieving fine grain size which was old as far back as the 1960's includes imparting substantial working effects such as cold work to aluminous metal followed by rapid heating to recrystallization temperature. However, despite the various approaches taken to improve either the superplastic forming operation or the metal stock going into the operation, there remains substantial room for improvement and an alloy which would enable the superplastic forming operation to proceed faster or at a lower temperature is both desirable and sought after.

SUMMARY OF THE INVENTION

In accordance with the invention, the superplastic forming performance of aluminum alloys is greatly enhanced by the addition thereto of small but effective amounts of the element scandium, for instance amounts in the range of 0.05 to 10%, preferably 0.1 to 5%. When additions above the maximum solid solubility are used (about 0.4 weight percent for the Al-Sc binary alloy), it will be appreciated that some form of rapid solidification should be used in casting or solidifying the alloy to avoid the formation of large and ineffective intermetallic constituents. The scandium addition is especially beneficial when the aluminum alloy contains a soluble element such as magnesium as explained hereinbelow. In accordance with the invention it has been found that elongation levels substantially exceeding 1000% can be achieved at temperatures as low as 750° F. and strain rates of 0.01 $sec^{-1}$ (1.0% per second). This performance translates into taking minutes to do what previously took hours and has to be considered remarkable by any standard, and is considered to greatly enhance superplastic forming of aluminous alloys. Such performance has been sought after in the aluminum superplastic forming art and is the subject of considerable government and privately funded research. Equally significant is the fact that the addition of scandium does not otherwise harm the performance of the aluminum alloy at the lower service temperatures normally used for aluminum alloys in structural applications. For instance, as indicated in U.S. Pat. No. 3,619,181, incorporated herein by reference, scandium can be included in aluminum alloys to improve strength properties at room and temperatures of about 149° C. (about 300° F.) and even up to temperatures up to 260° C. (about 500° F.). Accordingly, it was most surprising to see that this effect would practically reverse at superplastic forming temperatures wherein the addition of scandium weakens the metal in the sense of reducing the flow stress, that is, the stress applied to the metal to make it flow in superplastic forming operations.

THE DRAWINGS

Reference herein is made to the drawings, in which.

DETAILED DESCRIPTION

Figure 1:
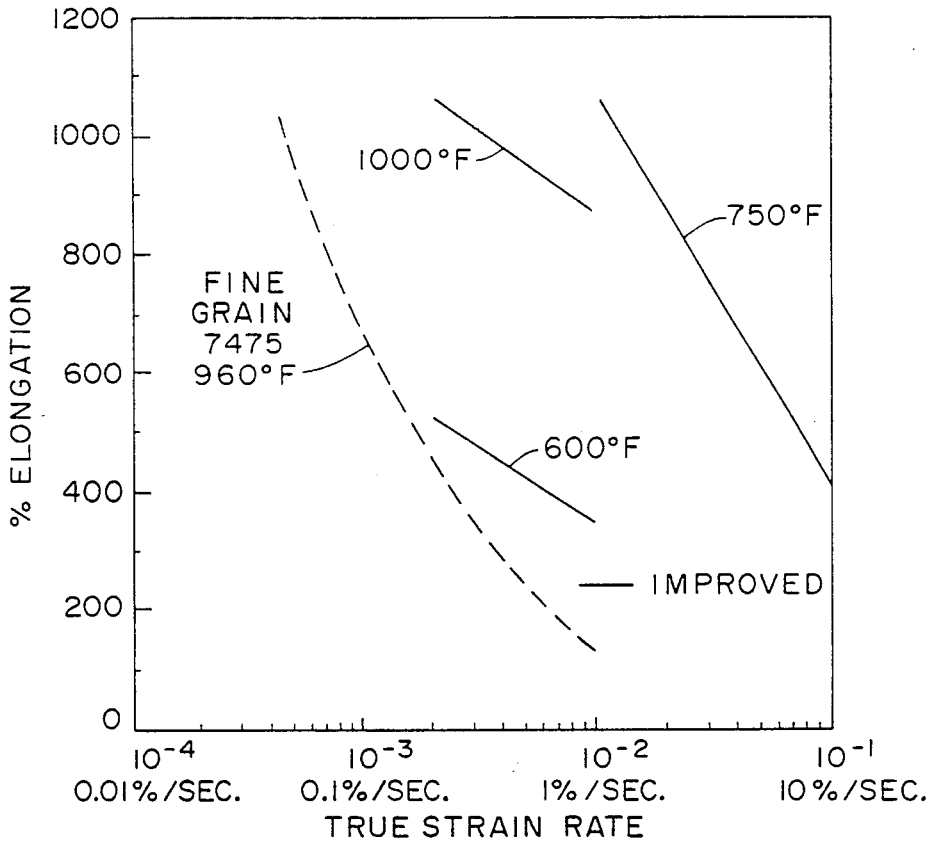
FIG. 1 is a graph plotting true strain rate versus longitudinal elongation.

The amount of scandium included in aluminum alloys in the practice of the invention ranges from a minimum of about 0.05% up to a maximum as high as 10% or even possibly higher, for instance up to 15%, if rapid solidification casting techniques are used, although it is preferred to employ a maximum of about 5% scandium or less for economic reasons. All composition percentages herein are by weight, and it is to be understood that aluminum alloys refer to aluminum metal containing greater than 50% aluminum, for instance, at least 60% aluminum. A suitable range for scandium is about 0.1 or 0.2 up to about 0.9 or 1% scandium. Within this range, the benefits of scandium are achieved at what is considered very reasonable cost, especially when the extent of the advantages is appreciated. One preferred scandium range is about 0.3 to about 0.7%.

In addition to scandium, it is preferred that the aluminum alloy contain one or more elements which are in solid solution at superplastic forming temperature and which, in combination with Sc, lower its flow stress at superplastic forming temperature. Accordingly, the aluminum alloy contains selected amounts of one or more of the elements magnesium, silicon, copper, silver, germanium, lithium, manganese, or zinc in an amount, typically 0.1% or more, that provides at least some of the element in solid solution at superplastic forming temperature and which alters the flow stress of the scandium-containing aluminous metal at superplastic forming temperature. The amounts for these elements, broadly stated, are up to 10% or 20% Mg, up to 2% or 5% Si, up to 10% Ag, up to 5% or 10% Cu, up to 5% Ge, up to 5% or 7% Li, up to 1.5% Mn, and up to 10% or 20% Zn. Of this group, a presently preferred embodiment includes magnesium present in amounts of 1 to 7 or 8%, with amounts of 2 to 6% being considered to render good performance and amounts of 3 to 5% Mg, preferably 3.5 to 4.5% Mg, offering quite impressive performance in accordance with the invention.

In addition to the elements recited above, the aluminous metal can also contain other elements such as Fe, Co, Ni, Zr, rare earth elements, or various other elements associated with aluminum and aluminum alloys as conscious additions or as incidental elements or as impurities, although, as indicated above, a presently preferred embodiment is an aluminum alloy containing about 3 to 5% Mg and about 0.2 to 0.8% Sc along with incidental elements and impurities. Constituents (intermetallic compounds) or phases which are insoluble at superplastic forming temperature can interfere or cause defects in superplastic forming. Accordingly, elements are preferably avoided in amounts or in combinations which favor formation of constituents at superplastic forming temperature. The amount of such an element tolerated depends in part on the rate of solidification and of heating employed in operations prior to superplastic forming. For instance, extremely rapid solidification of cast stock about 0.150-inch thick followed by cold rolling and rapid heating to superplastic forming temperature and fairly rapid superplastic forming can avoid formation of the relatively large insoluble phases which interfere with superplastic forming.

Silicon is an example of an element which can form insoluble phases and one preferred embodiment favors limiting Si to a maximum of 0.4 or 0.45% or possibly 0.5%, preferably 0.25% maximum especially where magnesium is present in the alloy. Other examples of elements which can form intermetallic compounds and phases which interfere with superplastic forming are Ca, Ti, V, Cr, Fe, Co, Ni, cerium, and the rare earth elements and the refractory elements such as Ta, W, Re, Mo, and Nb.

Soluble elements such as Zn, Cu, and Mg also can form insoluble constituents where one or more is present. For example, Cu and Mg can form constituents if both are present in sufficient amounts and processing temperatures favor precipitation.

One of the aspects observed in practicing some embodiments of the invention is the relation between the scandium-aluminum phase, believed to be approximately $Al_3Sc$, and the aluminum matrix in that the scandium-aluminum phase appears to be coherent with the aluminum phase, that is, having a crystal structure very similar to the aluminum phase such that the scandium-aluminum phase can be less pronounced or contrasted with the aluminum matrix than other phases appearing in various aluminum alloys. Because the aluminum-scandium phase has a structure very similar to that of the aluminum matrix, it is relatively stable at elevated temperatures and tends to resist coarsening during superplastic forming. The presence of this phase appears to prevent classical recrystallization from occurring during superplastic forming. The term "classical recrystallization" as used herein refers to the phenomenon wherein crystal growth occurs about nucleation sites and wherein the original crystal or grain boundaries as well as sub-grain structures within those boundaries substantially disappear and are replaced by substantially whole crystal grains with new grain boundaries.

The improved superplastic forming metal can be produced in accordance with methods used in producing other aluminum alloys in that, depending on the Sc content chosen, the alloy is readily castable into ingot, including thin ingot, such as by semi-continuous or continuous casting techniques, the latter including the various belt or drum casting techniques. In general, higher Sc content suggests smaller ingot size or higher chill rates in casting, or both. In a presently preferred embodiment of the invention, where Sc contents of about 0.2 to 0.8 are used, some form of mildly rapid solidification is desirable to obtain the best possible distribution of Sc-bearing phases. Chill rates of 15° C. or 20° C. (36° F.) per second or faster are generally preferred. One way to achieve this condition is to cast relatively thin ingot such as not over 4 inches thick, for instance about 1 or 2 inches thick. Higher Sc content preferably is accommodated with faster casting chill rates. The solidification rate desired is related to the presence of certain other elements in addition to Sc. As a general rule, the greater the content of elements other than aluminum, especially elements which form intermetallic phases insoluble at superplastic forming temperature, the higher the desired casting chill rate.

In producing superplastic sheet, it is desirable to impart work into the metal to break up the cast structure and alter the grain texture. Accordingly, ingot is hot rolled then cold rolled, although a thin-cast alloy such as an alloy cast to a thickness of $\frac{1}{8}$ inch or the like can dispense with hot rolling and go directly to cold rolling. In producing aluminous metal in accordance with the invention, it is preferred that the alloy be worked to a reduction of at least 30%, typically 90% or more. This breaks up the cast structure and strengthens the alloy. The working can be relatively hot (550° F. to 750° F.) or cold or both. Working can include rolling or extrusion, forging or other working operations. While working is preferred, it may be possible in some cases, for instance for superplastic forging, that the as-cast stock can be superplastically formed.

The Al-Mg-Sc alloy does not require a high temperature preheat before working when cast in thin ingot. Heating to 550° F. before hot working is adequate. One preferred practice includes hot working at the lowest temperature usable without excessive break-up of the working stock. The preferred Al-Mg-Sc alloys are considered heat-treatable alloys and some precipitation of the $Al_3Sc$ can occur during hot rolling. Higher amounts of Sc or higher amounts or numbers of precipitate-forming elements further favor the use of lower working temperatures and shorter times at elevated temperature.

It is desired to perform any hot rolling above 550° F. to avoid cracks, but it is preferred to keep hot rolling temperatures not exceeding 800° F. or preferably not above 750° F. to help avoid modifying or coarsening the $Al_3Sc$ phase to the extent of possibly degrading superplastic forming performance. That is, while the Al-Sc phase is relatively stable at elevated temperatures, it is considered preferable to avoid substantial periods of time at temperatures above 800° F. in producing the alloy product.

It is believed that the addition of Sc will improve the superplastic forming performance of alloys such as 7475, which are now considered to have superplastic characteristics. However, alloys such as 7475 whose Aluminum Association sales limits are 5.2 to 6.2% Zn, 1.9 to 2.6% Mg, 1.2 to 1.9% Cu, 0.18 to 0.25% Cr, balance Al and incidental elements and impurities, and others which include precipitate-forming elements are preferably processed by operations which do not favor formation of precipitates which are insoluble at superplastic forming temperature. The 7475 alloy would be brought to superplastic forming temperature, about 940° F. to 960° F., and formed into the desired shape. Since a 950° F. forming temperature is suited for solution heat treating this alloy, it can be quenched and aged right after forming.

From the preceding, it can be seen that preferred operations in processing the selected alloy composition into a wrought product include casting at high or fairly high chill rates to produce work stock. Working, including associated heating, is preferably carried out at lower temperatures or at moderate elevated temperatures, for instance 550° F. to 750° F. or 800° F., to reduce formation of undesired precipitated phases. Higher temperatures are less preferred but usable if employed for short enough time to avoid undesired precipitates. The preferred practices are more important where elements are present in the alloy which tend to produce precipitates which are insoluble or agglomerate at superplastic forming temperature sufficiently to interfere with the subsequent superplastic forming operation.

EXAMPLE I

In order to demonstrate the improvement achieved according to the practice of the invention, the following illustrative Example proceeds. Alloys of various compositions indicated in Table I were semi-continuously cast at relatively high chill rates into ingots 1-inch×6-inches and 2½ inches×12-inch in cross-section and then hot and cold rolled into sheet about 0.1-inch thick. The hot rolling operation at 550° F. produced a sheet of about 0.25-inch thick which was cold rolled to a final gauge of 0.1 inch, a cold reduction of 60%. Without a separate annealing or recrystallization treatment, the sheet was heated to temperatures of 750° F. in some cases and 1000° F. in other cases for superplastic property measurement. The flow stress and elongation were measured at both temperatures and are listed in Table I.

TABLE I

| Alloy | Strain Rate | | Temperature | Flow Stress | | Elongation |
|---|---|---|---|---|---|---|
| | $sec^{-1}$ | % per second | °F. | KSI | MPA | % |
| Al—0.5 Sc | .01 | 1% | 750 | 7.8 | 54 | 92 |
| Al—0.5 Sc | .002 | 0.2% | 1000 | 1.5 | 10 | 157 |
| Al—4 Mg | .01 | 1% | 750 | 6.7 | 46 | 194 |
| Al—4 Mg | .002 | 0.2% | 1000 | 1.3 | 9 | 210 |
| Al—4 Mg—0.5 Sc | .01 | 1% | 750 | 4.6 | 32 | 1050 |
| Al—4 Mg—0.5 Sc | .002 | 0.2% | 1000 | 0.9 | 6 | 1050 |
| Al—6 Mg—0.5 Sc | .01 | 1% | 750 | 4.9 | 34 | 341 |
| Al—6 Mg—0.5 Sc | .002 | 0.2% | 1000 | 0.9 | 6 | 1050 |

From Table I it is readily clear that the alloy containing 4% magnesium and 0.5% scandium performed extraordinarily well in that an elongation exceeding 1000% was achieved at both 1000° F. and 750° F. and that the flow stress level at 1000° F. was a mere 900 psi with the performance at 4% Mg in the particular test exceeding the performance level at 6% Mg. It is to be appreciated that elements such as Mg, which are soluble at superplastic forming temperatures, can be used to substantial advantage in practicing the invention. At 750° F. the superplastic forming performance of the sample containing Sc and 4% Mg substantially exceeded that of the alloy containing Sc and 6% Mg which exhibited an elongation of only 341% which, while impressive, can be considered as marginal in some situations. At 1000° F., however, the 6% Mg alloy performed quite well. Accordingly, the performance of the aluminum alloy stock can be heightened with respect to the superplastic forming temperature to optimize results both with respect to superplastic forming conditions and with respect to anticipated service requirements. That is, in viewing Table I it will be apparent to those skilled in the art that while the 4% Mg alloy has superior superplastic performance at 750° F., the 6% Mg alloy at 1000° F. performs as well or better and would have greater strength at room service temperature. Accordingly, the invention contemplates that additions of an element such as Mg or Cu or Zn or Li can be made in varying amounts in test specimens which (preferably after cold rolling) are tested at different superplastic forming temperatures and then the appropriate composition and superplastic forming temperature selected in accordance with the teachings of this invention to blend optimum or at least superior superplastic forming performance with service performance. In practicing the invention it has been found that the presence of an element such as Mg soluble at superplastic forming temperatures interacts somehow with Sc in improving superplastic forming performance over an aluminum-scandium alloy without the presence of such an element.

EXAMPLE II

The advantages of the invention can be illustrated by comparison with another superplastic forming material such as superplastic 7475 material. FIG. 1 illustrates superplastic performance plotting elongation versus true strain rate for superplastic 7475 at 960° F., a preferred superplastic forming temperature for 7475 alloy, and for the improved material containing 4% magnesium and 0.5% scandium at temperatures of 600° F., 750° F., 900° F., and 1000° F. The superplastic 7475 was specially processed to produce a very fine grain size and superplastic performance. The improved material was made by hot and cold rolling wherein an ingot was hot and continuously rolled to a thickness of about ¼ inch followed by cold rolling to final gauge of 0.1 inch. In FIG. 1, the improvement performance is shown as solid lines and 7475 performance by dashed line. From FIG. 1 it is readily apparent that all of the data for the improvement are to the right side of the superplastic 7475 curve which indicates superior performance. At both 750° F. and 1000° F. the improved material facilitates a higher elongation for a given strain rate or a higher permissible strain rate for a given elongation. The data show that the improved metal has elongation at superplastic forming temperatures which is equal to or greater than that for superplastic 7475 but that higher strain rates can be used to form the improved metal. The improved superplastic metal exhibits more elongation than superplastic 7475 even when the improved alloy is strained 25 times faster than the strain rate for 7475. Further, at a strain rate of 0.01 per second (1% per second), the improved superplastic metal has many times the elongation of superplastic 7475. This highlights the superior superplasticity of the improved superplastic metal.

It has to be remembered in this connection that in superplastic forming great cost savings can be achieved if strain rate can be increased to facilitate higher production rates. Still further, at any given temperature the improvement facilitates higher strain rate and/or higher superplastic elongation. Achieving all of these benefits by adding scandium is indeed considered surprising especially when this level of performance is obtained without intricate processing steps.

Figure 2:
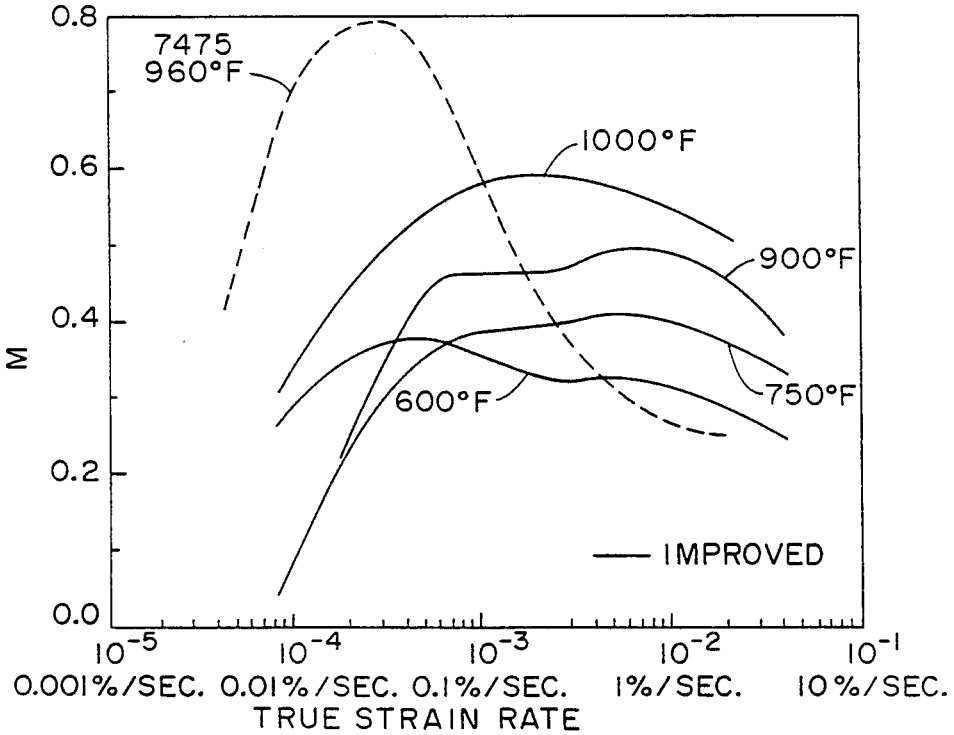
FIG. 2 is a graph plotting strain rate sensitivity parameter "M" versus true strain rate.

It is presently believed that the basic mechanism responsible for the superplastic behavior of the improved superplastic materials may be different from the mechanism for other superplastic alloys. It is generally recognized or believed that alloys which have a strain rate sensitivity greater than 0.5 are considered good superplastic performing alloys, whereas those having a strain rate sensitivity less than 0.5 would be expected to show poor superplastic performance. However, the present improved superplastic materials can exhibit a strain rate sensitivity less than 0.5 which might, using conventional wisdom, suggest that the improved metal would not have good superplastic properties. However, the striking superior results with the improved superplastic metal would certainly defy such an impression which makes the results all the more surprising. FIG. 2 plots strain rate sensitivity parameter M versus true strain rate for the improved Al-4Mg-0.5 Sc alloy at 600° F., 750° F., 900° F., and 1000° F. (solid lines) and includes comparison with superplastic fine grain 7475 (dashed line). The strain rate sensitivity parameter M is recognized as indicating the ability of a material to distribute strain during deformation. Greater distribution of strain (higher M value) delays fracture, and it is generally considered desirable to superplastically form at a strain rate corresponding to the highest M value.

FIG. 2 illustrates further information to suggest that the mechanism responsible for the superplasticity of the improved materials may the different than for other superplastic aluminum alloys such as fine grain 7475. The maximum value of strain rate sensitivity for the improved materials occurs at a strain rate which is an order of magnitude greater than for superplastic 7475. Also, the strain rate at which the maximum strain rate sensitivity occurs does not decrease as temperature is decreased from 1000° F. to 750° F. for the improved superplastic materials, whereas experience with superplastic 7475 alloy does show such a decrease.

Another aspect of improvement shown in FIG. 2 is the relative flatness of the improvement curves as contrasted with the peaky curve for 7475. This translates to a beneficial lack of criticality for strain rate in using the improved superplastic forming materials as contrasted with 7475 whose curve peaks quickly and falls off indicating a much higher amount of sensitivity to superplastic forming rate. This lack of sensitivity to forming condition for the improved material translates to allowing forming of more complex parts, faster and with less expensive tooling.

The superplastic 7475 used for the foregoing comparison was specially processed to achieve very fine grain size which is considered to correlate with superplastic forming characteristics. Not only is the performance of the present improvement so much better than the 7475, but that performance is achieved without special fine grain processing. The grain size of the improved sheet was essentially the same as cast except that rolling had changed the grain shapes. The striking superplastic forming performance of the improved aluminum products may not fit with mechanisms considered in the art to correlate with superplastic performance. The exact mechanism responsible for the improvement is not known but may be related to some ability of $Al_3Sc$ dispersoid phases to control grain boundary motion.

While the invention has been described to this point in terms of alloys including scandium to achieve superior superplastic forming capabilities, it has also been discovered that other elements can be included to significant advantage in improving superplastic forming performance. Accordingly, the invention includes use of the elements yttrium (Y), gadolinium (Gd), holmium (Ho), dysprosium (Dy), erbium (Er), ytterbium (Yb), lutetium (Lu), and terbium (Tb) in superplastic aluminum. In aluminum each of these elements can form the intermetallic phase $Al_3X$, where X is one of the aforementioned elements as indicated hereinabove. Scandium likewise forms such a phase with aluminum. In addition, scandium and the other aforesaid elements just mentioned are capable of forming in aluminum the phase $Al_{13}(X—X')$ wherein X is scandium or one of the elements just mentioned and X' is also one of such elements but is different than X. More than two X elements can be utilized (e.g. $Al_3X—X'—X''$, etc.). The aforesaid elements are present in amounts of at least about (0.01 or 0.02%) for instance about 0.04 or 0.05 up to maximum amounts of 4% or 5% or up to 10%, preferably 0.1 to 5% each. The grand total of such elements is not over 15% or 20% preferably not over 10% or 5%. Much of what was said hereinabove respecting scandium applies to these other elements which can be used to special advantage in combination with scandium, that is wherein X is scahdium and X, is one of the other elements just mentioned.

It is believed that the crystallographic character of the $Al_3X$ phases is an important part of the invention. Aluminum's crystallography features a face-center cubic (fcc) structure as is well known. The above-identified phases also exhibit a structure that is closely related to the fcc structure. This structure is a primitive cubic structure. It is in the crystallographic space group Pm3m as defined in Metals Handbook, Desk Edition, "Crystal Structure", C. S. Barrett, pages 2-1 to 2-16, American Society for Metals, published 1985, incorporated herein by reference, and is designated by the Strukturbericht symbol $L1_2$ and the Pearson symbol cP4. The prototype structure is $Cu_3Au$. The $Cu_3Au$ structure resembles an fcc structure with the Au atom on the corner location of the unit cell and the 3 Cu atoms on the faces. It is to be understood that all $Al_3M$ (M=metal) phases do not have the $L1_2$ structure. The $Al_3X$ phase contemplated by the invention features the $L1_2$ structure wherein X (e.g. Sc) atoms are located on the cube corners and Al atoms on the face centers. For example, Y, Dy and Ho form other $Al_3X$ structures in addition to the $L1_2$ structure and the invention practice includes achieving the $L1_2$ structure. Equally importantly in the invention is the fact that the lattice parameter or "a" dimension (the length of the cube side) of the phase particles approximates that for aluminum. In Table II, the lattice parameter is listed for a number of such phases together with aluminum and it can be seen that the lattice parameter for $Al_3Sc$ (0.4105 nanometers) is closest to that of aluminum (0.4049 nm), a nanometer being $1\times10^{-9}$ of a meter. An appreciation of the significance of the lattice parameter dimension and the closeness of the values listed in Table II is provided by comparison with more common phases in aluminum such as those listed below in Table III. Thus two important features for the phases listed in Table II in practicing the invention are, first the fact that all comprise $L1_2$ crystallographic structure, and second that the lattice parameter ("a" dimension) for said structure closely approximates that of the aluminum matrix. This results in a very high degree of compatibility between the aluminum matrix and the aforesaid phase which is considered to contribute very substantially to the improved results achieved in practicing the invention.

TABLE II

| $Al_3X$ Phases with $L1_2$ Structure in Aluminum | |
|---|---|
| Phase | Lattice Parameter "a" (nm) |
| $Al_3Sc$ | 0.4105 |
| $Al_3Y$ | 0.4323 |
| $Al_3Dy$ | 0.4236 |
| $Al_3Ho$ | 0.4230 |
| $Al_3Er$ | 0.4215 |
| $Al_3Yb$ | 0.4202 |
| $Al_3Lu$ | 0.4187 |
| $Al_3$(.6 Sc—.4 Y) | 0.4168 |
| $Al_3$(.6 Sc—.4 Dy) | 0.4190 |
| $Al_3$(.85 Sc—.15 Gd) | 0.4118 |
| $Al_3$(.6 Sc—.4 Tb) | 0.4196 |
| $Al_3$(.7 Sc—.3 Ho) | 0.4199 |
| $Al_3$(.5 Sc—.5 Er) | 0.4160 |
| $Al_3$(.98 Er—.02 Y) | 0.4215 |
| $Al_3$(.98 Er—.02 Tb) | 0.4216 |
| Al | 0.4049 |

TABLE III

| Aluminum Alloy Type | Phase | Crystal Type | Lattice Dimension (nm) |
|---|---|---|---|
| 2XXX | $Al_2Cu$ | tetragonal | a = 0.6066<br>c = 0.4874 |
| 2XXX | $Al_2CuMg$ | orthorhombic | a = 0.401<br>b = 0.925<br>c = 0.715 |

TABLE III-continued

| Aluminum Alloy Type | Phase | Crystal Type | Lattice Dimension (nm) |
|---|---|---|---|
| 5XXX | $Al_8Mg_5$ | hexagonal | a = 1.13<br>c = 1.7 |
| 7XXX | $MgZn_2$ | hexagonal | a = 0.52<br>b = 0.85 |

Table IV lists a number of combinations practicable in accordance with the invention wherein different elements from the above-identified listing are grouped into selected phase compositions and Table IV lists the lattice parameter misfit percent determined by dividing the difference between the aluminum lattice parameter dimension and that of the phase by 0.4049, the lattice parameter dimension for aluminum. In the case of scandium, this is determined by subtracting 0.4049(Al) from 0.4105($Al_3Sc$) and dividing that difference (0.0056) by 0.4049 to provide a misfit percentage of 1.38% in Table III.

TABLE IV

| Phase | Misfit (pct.) |
|---|---|
| $Al_3Sc$ | +1.38 |
| $Al_3(Sc_{0.85}Gd_{0.15})$ | +1.70 |
| $Al_3Y$ | +6.77 |
| $Al_3(Sc_{0.6}Y_{0.4})$ | +2.99 |
| $Al_3Ho$ | +4.47 |
| $Al_3(Sc_{0.7}Ho_{0.3})$ | +3.70 |

In practicing the invention the lattice parameter misfit as determined above should not exceed 10%, preferably not exceed more preferably not exceed 5%. Misfits not exceeding 3% or are highly desirable in practicing the invention.

Table V lists several alloys in accordance with the invention, and Table VI compares the phase fraction transformed after three hours at 410° F. (210° C.) aging for each of the complex ($Al_3Sc$-X') compositions set forth in Table IV with that for $Al_3Sc$. In Table VI, "R" designates a recast condition and "RCR" designates recasting followed by cold rolling. Table VI illustrates that the precipitation behavior of the complex $Al_3X$—X' phases is much like that of the $Al_3Sc$ phase.

TABLE V

| Aluminum Alloys | | | | | |
|---|---|---|---|---|---|
| | | Composition (wt. pct.)* | | | |
| Alloy | Phase | Sc | Gd | Y | Ho |
| 1 | $Al_3Sc$ | 0.5 | | | |
| 2 | $Al_3$(Sc,Gd) | 0.5 | 1.7 | | |
| 3 | $Al_3Y$ | | | 1.0 | |
| 4 | $Al_3$(Sc,Y) | 0.5 | | 1.0 | |
| 5 | $Al_3Ho$ | | | | 1.8 |
| 6 | $Al_3$(Sc,Ho) | 0.5 | | | 1.8 |

*Alloys contain 0.3 at. pct. of each addition, balance essentially aluminum and impurities.

TABLE VI

| | Fraction Transformed | |
|---|---|---|
| | R | RCR |
| Al—Sc | 0.502 | 0.566 |
| $Al_3Sc_{0.6}Y_{0.4}$ | 0.564 | 0.638 |
| $Al_3Sc_{0.85}Gd_{0.15}$ | 0.527 | 0.578 |
| $Al_3Sc_{0.7}Ho_{0.3}$ | 0.554 | 0.654 |

Table VII shows that the more complex phases enhance the strength of aluminum over that of the simple aluminum scandium system when the alloy is cold worked to a cross-section reduction of over 95%. As can be seen in Table VII, the strength is significantly higher in the more complex systems than in the simple Al-Sc system. While this strength is not necessarily a factor in superplastic forming, it is useful after superplastic forming. The strength enhancement would also contribute to an alloy including other elements, such as Mg.

TABLE VII

| | Strength After Cold Working | |
|---|---|---|
| Alloy | Yield Strength (psi) | Tensile Strength (psi) |
| Al—Sc | 35,300 | 37,100 |
| Al—Sc—Y | 40,000 | 42,200 |
| Al—Sc—Gd | 43,700 | 44,700 |
| Al—Sc—Ho | 37,200 | 38,700 |

Accordingly, it is to be appreciated that in the practice of the invention certain other elements may be utilized in lieu of scandium or in addition to scandium and that the invention in a broader sense encompasses such embodiments.

Still further, other elements or alloying metals can be included in the superplastic working stock. The amounts of other elements or metals include up to 20% Mg (e.g. 0.1 to 20% Mg), up to 49% Zn (e.g. 0.1 to 49% or 0.1 to 15% Zn) or even higher levels of zinc, even possibly exceeding the amount of aluminum, up to 7% Li (e.g. 0.1 to 7% Li), up to 10% Cu (e.g. 0.1 to 10% Cu), up to 5% Si (e.g. 0.1 to 5% Si), up to 10% Ag (e.g. 0.1 to 10% Ag), up to 5% Ge (e.g. 0.1 to 5% Ge) and possible other elements such as up to 0.3 or 0.4% Zr and other elements such as Mn, Cr, Fe and others useful in alloying with aluminum. While aluminum alloys comprising more than 50% aluminum are contemplated in practicing the invention, the invention envisions alloys possibly containing 50% or less aluminum, especially, but not necessarily, where the aluminum content exceeds that of any other single element. Still further, in its broadest expression, the invention contemplates utilizing in superplastic aluminous workstock the presence of phases or particles having an $L1_2$ crystal structure wherein the principal lattice parameter does not differ from that for aluminum by more than about 10%, preferably not more than 7%, more preferably not more than 5% with a misfit percent not exceeding 2 or 3% being very highly preferred. The amount of such phase or phases present can vary from 0.02% to about 5% or about 10% or 15% or even 20% or 25% or more of the stock. The improvement results in superior superplastic forming and superplastically formed products.

Another desirable feature for aluminum stock in superplastic forming is that it have an unrecrystallized structure and that an unrecrystallized structure also be present in the superplastically formed article. The practice of the invention facilitates providing superplastically formed products in an unrecrystallized condition characterized by the strength and other known benefits of the unrecrystallized structure. Other superplastic aluminum alloy parts produced by previous approaches have typically featured a recrystalled structure tracing back to processing used to achieve a fine (but recrystallized) grain structure. The present invention can be practiced without using practices producing fine recrystallized grains and such fact enables using unrecrystallized superplastically formed parts.

Another embodiment of the invention utilizes zirconium (Zr) along with scandium in a heat treatable aluminum alloy. The heat treatable aluminum alloys 2XXX (Cu major alloy addition), 6XXX (Mg and Si major alloy additions) and 7XXX (Zn major alloy addition) are stronger than other aluminum alloys but their processing includes exposure to substantial temperatures after rolling into sheet or other working operations to make suitable wrought products. High processing temperatures (for example, solution heat treatment can be 800° or 900° F.) can deteriorate the beneficial effect of Sc containing phases which can coarsen excessively during extended exposure to reduce the beneficial effect of Sc. Combining Zr with Sc addition improves results, possibly by reducing the effect just described.

British Alcan's alloy "Supral" based on Al-Cu-Zr typically contains about 6% Cu and about 0.4% or more Zr. It exhibits superplastic performance with a relatively high optimum strain rate of around 0.002/second but has a yield strength of only about 60 ksi. Superplastic 7475 has much better yield strength, about 70 ksi, but can require slower forming rates such as 0.0002/second, an order of magnitude slower. The present improvement provides for strength levels equal to or even higher than 7475, for instance, yield strengths of about 70 to 75 ksi while allowing for superplastic forming rates of about 0.002/second, an order of magnitude faster than superplastic 7475.

The alloys so benefitted are the heat treatable 7XXX (preferred), 2XXX and less preferably 6XXX alloys. In referring to 2XXX, 6XXX or 7XXX alloys, such refers to alloys having their major alloy additions as described above (e.g., Zn for 7XXX, Cu for 2XXX) irrespective of whether the alloy is registered with the Aluminum Association. The 2XXX alloys contain substantial amounts of Cu along with Mg or Mn, or both. Some 2XXX alloys are 2024, 2124, 2224, 2324, 2018 and 2218. Table VIII illustrates compositions for some 2XXX alloys registered with the Aluminum Association.

For convenience, the 2XXX alloys here concerned can be described as containing about 3.7 or 3.8 to about 5 or 6 or 7% Cu, and typically one or more of about 0.2 to 1% Mn and about 0.3 or 0.4 to 2 or 3% Mg, together with other elements as may be desired and incidental elements and impurities. However, lower amounts of Cu, such as 3 or 3.2 or 3.4% or 3.6%, can also be included, although the higher amounts stated above are preferred.

7XXX alloys contain substantial amounts of Zn. Some 7XXX alloys are 7050, 7150, 7049, 7149, 7075, 7175, 7475. Table IX illustrates compositions for some 7XXX alloys registered with the Aluminum Association. For convenience herein, 7XXX alloys can be described as containing about 4 to 10 or 12% Zn, about 1 or 1.5 to 3.5% Cu, about 1 or 1.5 to 3 or 3.5% Mg, along with one or more of 0.1 to 0.5% Mn, 0.05 to 0.3% Cr, or 0.04 to 0.15 or 0.2% Zr, together with other elements such as 0.03 to 0.3% or 0.4% hafnium or 0.03 to 0.15% vanadium that may be desired and incidental elements and impurities. Including a combination of about 0.04 to about 0.2 or 0.25% Zr and about 0.05 to about 1% Sc in these alloys can impart substantial superplastic forming characteristics. Preferred limits in accordance with the invention for zinc are about 5 or 5.5% up to about 7 or 8% or possibly 9 or 10% Zn, 1.5 or 2% up to about 2.5 or 3% Mg, 1 to 2% copper in some embodiments, and around 2 to 2.6 or 2.7% copper in other embodiments, together with about 0.07 or 0.08 to about 0.15 or 0.20% Zr and about 0.1 to about 0.5 or 0.6% Sc. A presently preferred embodiment is an alloy much like 7050 and its close variant 7150, both collectively referred to herein as 7X50, containing about 5.5 or 5.6 to about 6.9 or 7.1% Zn, about 1.8 or 1.9 to about 2.7 or 2.8% Mg, about 1.8 or 1.9 to about 2.6 or 2.7% Cu, about 0.05 to about 0.2 or 0.25% Zr, for instance, 0.08 to 0.14% Zr, about 0.1 to 0.7% Sc, for instance, about 0.2 or 0.3 or more to about 0.5 or 0.6% Sc, balance essentially aluminum and incidental elements and impurities. This alloy exhibits very good superplastic forming characteristics (for example, 800% elongation at a forming rate of 0.002/second) along with very good strength and corrosion resistance properties.

While the invention is especially suited to 7XXX type alloys and is also considered suited to 2XXX alloys as described above, the invention is believed to be suited to 6XXX alloys although possibly on a less preferred basis.

The 6XXX alloys contain substantial amounts of Si and Mg usually in amounts stoichiometrically related to magnesium silicide (Si or Mg, however, can be in excess) together with one or more of Cu, Mn or Cr. Typical 6XXX alloys registered with the Aluminum Association are shown in Table X.

TABLE VIII

| | Typical 2XXX Alloys Registered with Aluminum Association | | | | | | | | |
|---|---|---|---|---|---|---|---|---|---|
| | Si | Fe | Cu | Mn | Mg | Zn | Zr | V | Ti |
| 2004 | .20 | .20 | 5.5–6.5 | .10 | .50 | .10 | .30–.50 | | |
| 2024 | .50 | .50 | 3.8–4.9 | .3–.9 | 1.2–1.8 | .25 | | | .15 |
| 2124 | .20 | .30 | 3.8–4.9 | .3–.9 | 1.2–1.8 | .25 | | | .15 |
| 2224 | .12 | .15 | 3.8–4.4 | .3–.9 | 1.2–1.8 | .25 | | | .15 |
| 2324 | .10 | .12 | 3.8–4.4 | .3–.9 | 1.2–1.8 | .25 | | | .15 |
| *2018 | .9 | 1.0 | 3.5–4.5 | .20 | .45–.9 | .25 | | | |
| *2218 | .9 | 1.0 | 3.5–4.5 | .20 | 1.2–1.8 | .25 | | | |
| 2219 | .20 | .30 | 5.8–6.8 | .2–.4 | .02 | .10 | .10–.25 | .05–.15 | .02–.10 |
| 2319 | .20 | .30 | 5.8–6.8 | .2–.4 | .02 | .10 | .10–.25 | .05–.15 | .10–.20 |
| 2419 | .15 | .18 | 5.8–6.8 | .2–.4 | .02 | .10 | .10–.25 | .05–.15 | .02–.10 |

*2018 and 2218 also contains 1.7–2.3 Ni.
Single values designate maximum levels

TABLE IX

| | Typical 7XXX Alloys Registered with Aluminum Association | | | | | | | | |
|---|---|---|---|---|---|---|---|---|---|
| | Si | Fe | Cu | Mn | Mg | Cr | Zn | Zr | Ti |
| 7050 | .12 | .15 | 2.0–2.6 | .10 | 1.9–2.6 | .04 | 5.7–6.7 | .08–.15 | .06 |
| 7150 | .12 | .15 | 1.9–2.5 | .10 | 2.0–2.7 | .04 | 5.9–6.9 | .08–.15 | .06 |
| 7049 | .25 | .35 | 1.2–1.9 | .20 | 2.0–2.9 | .10–.22 | 7.2–8.2 | | .10 |
| 7149 | .15 | .20 | 1.2–1.9 | .20 | 2.0–2.9 | .10–.22 | 7.2–8.2 | | .10 |
| 7075 | .4 | .5 | 1.2–2 | .30 | 2.1–2.9 | .18–.28 | 5.1–6.1 | | .20 |
| 7175 | .15 | .20 | 1.2–2 | .10 | 2.1–2.9 | .18–.28 | 5.1–6.1 | | .10 |
| 7475 | .10 | .12 | 1.2–1.9 | .06 | 1.9–2.6 | .18–.25 | 5.2–6.2 | | .06 |

Single value designation maximum level

TABLE X

| | Typical 6XXX Alloys Registered with Aluminum Association | | | | | | | |
|---|---|---|---|---|---|---|---|---|
| | Si | Fe | Cu | Mn | Mg | Cr | Zn | Zr |
| 6009 | .6–1 | .5 | .15–.6 | .2–.8 | .4–.8 | .10 | .25 | — |
| 6010 | .8–1.2 | .5 | .15–.6 | .2–.8 | .6–1 | .10 | .25 | — |
| 6061 | .4–.8 | .7 | .15–.4 | .15 | .8–1.2 | .04–.35 | .25 | — |
| 6063 | .2–.6 | .35 | .10 | .10 | .45–.9 | — | .05 | — |
| 6007 | .9–1.4 | .7 | .2 | .05–.25 | .6–.9 | .05–.25 | .25 | .05–.2 |
| 6205 | .6–.9 | .7 | .2 | .05–.15 | .4–.6 | .05–.15 | .25 | .05–.15 |
| 6070 | 1–1.7 | .5 | .15–.4 | .4–1 | .5–1.2 | .10 | .25 | — |

Single value designates maximum level.

The 6XXX alloys can be described as containing about 0.2 to about 2% Si, about 0.3 or 0.4 to about 1.5 or 2% Mg and one or more of about 0.15 to 0.8 or 1% Cu, about 0.05 or 0.1 to about 0.8 or 1 or 1.2% Mn and about 0.04 to 0.4% Cr, together with other alloy additions as may be desired and incidental elements and impurities.

In practicing the invention, the alloy contains scandium and zirconium as discussed above. The amount of scandium ranges from about 0.05 or 0.1 to about 0.5 or 0.6%; but higher amounts up to 1% or even higher up to 5% can be used. In addition to or possibly in lieu of the scandium, or at least some of the scandium, there may be substituted elements Y, Gd, Ho, Dy, Er, Yb, Lu or Tb, for instance, in the amounts hereinabove set forth, although scandium is preferred.

In practicing the invention, the zirconium should not exceed 0.25% and preferably does not exceed 0.2% for conventional casting techniques with levels of about 0.09 or 0.1 to about 0.15 or 0.17% being suitable. Higher zirconium contents of 0.3 or 0.4 or 0.5% would interfere with achieving the desired property combinations of superplasticity combined with high strength, toughness and the other properties for which alloys of this type, for instance, alloy 7X50, are known. That is, high amounts of Zr such as 0.3 or 0.4 or 0.5% can introduce problems in fabrication in that the Zr is not properly distributed unless special (high solidification rate) casting techniques are used. These techniques can add substantially to cost whereas lower Zr amounts such as 0.12 or so (up to about 0.2 or 0.25% Zr) are more compatible with casting large ingot for rolling into sheet. The manufacturing and other advantages of processes using large ingot fabrication can thus be utilized in practicing the invention. For every numerical range set forth, it should be noted that all numbers within the range, including every fraction or decimal between its stated minimum and maximum, are considered to be designated and disclosed by this description. As such, an elemental range of about 4 to 10% zinc expressly covers zinc contents of 4.1, 4.2, 4.3 . . . and so on, up to about 10% zinc.

EXAMPLE

To illustrate the benefits of the invention, superplastic performance in terms of true strain versus true stress was measured for an alloy corresponding to alloy 7050 plus Sc. This alloy can readily be produced economically as a sheet type product using conventional (large ingot) fabrication and finishing practices. The alloys contained Zn, Cu and Mg within the registered limits for 7050 (5.7–6.7% Zn, 1.9–2.6% Mg and 2.0–2.6% Cu) and 0.11 or 0.13% Zr (within the registered Zr limits of 0.08 to 0.15% for 7050) together with Sc in amounts of 0.17, 0.28, 0.29 and 0.33%. These alloys performed very well at 890° F. and a strain rate of 0.002/second. The true stress required was relatively modest, less than 10 MPa (1.43 ksi) for most tests and typically between around 4 and 8 MPa (0.57–1.14 ksi) and elongations ranged from about 548% to about 718% or higher. For this degree of superplasticity to be achieved at a strain rate of 0.002/second is considered very significant, especially when combined with the recognized strength, toughness and corrosion resistance performance of 7X50 type alloys It is considered significant that for this particular alloy neither Zr nor Sc alone in the amounts used could reach this performance level which required the presence of both Sc and Zr.

While the invention has been described in terms of preferred embodiments, the claims appended hereto are intended to encompass all embodiments which fall within the spirit of the invention.

What is claimed is:

1. In a method of superplastic forming wherein aluminum alloy metal is superplastically formed at superplastic forming temperature, the improvement comprising providing said aluminum alloy metal comprising aluminum and including some amount up to 10% of one or more of the elements from the group of scandium, yttrium, gadolinium, holmium, dysprosium, erbium, ytterbium, lutetium, and terbium, the grand total of said elements in said group not exceeding 20%, the amount, if any, of zirconium in said alloy being 0.25% or less.

2. The method according to claim 1 wherein said aluminum alloy contains one or more of the following elements: up to 20% Mg, up to 5% Si, up to 10% Ag, up to 10% Cu, up to 5% Ge, up to 7% Li, up to 49% Zn and up to 0.25% Zr.

3. The method according to claim 1 wherein said aluminum alloy contains 0.01 to 10% Sc and one or more of the elements up to 20% Mg, up to 5% Si, up to 10% Ag, up to 10% Cu, up to 5% Ge, up to 7% Li, up to 49% Zn and up to 0.2% Zr.

4. An improved superplastically formed articles of manufacture comprising an aluminum alloy comprising more than 50% aluminum and including some amount up to 10% of one or more elements from the group of scandium, yttrium, gadolinium, holmium, dysprosium, erbium, ytterbium, lutetium, and terbium, the grand total of said elements in said group not exceeding 20%, the amount, if any, of zirconium being 0.25% or less.

5. The improved article according to claim 4 wherein said aluminum alloy contains one or more of the following elements: 0.1 to 20% Mg, 0.1 to 4% Si, 0.1 to 10% Ag, 0.1 to 10% Cu, 0.1 to 5% Ge, and 0.1 to 7% Li and 0.1 to 49% Zn.

6. The improved article according to claim 4 wherein said aluminum alloy contains 0.1 to 5% Li.

7. The improved article according to claim 4 wherein said alloy contains 0.01 to 5% Sc.

8. In a method of superplastic forming wherein aluminum alloy stock is superplastically formed at superplastic forming temperature, the improvement comprising: providing said aluminum alloy comprising a heat treatable 2XXX, 6XXX or 7XXX aluminum alloy containing about 0.05 to 1% scandium and about 0.05 to 0.25% zirconium.

9. In the method according to claim 1 wherein said aluminum alloy further contains 0.05 to 5% one or more of the group of yttrium, gadolinium, holmium, dysprosium, erbium, ytterbium, lutetium.

10. In the method according to claim 8 wherein said alloy is selected from:

(a) 7XXX alloys containing about 4 to 10% Zn, 1 to 3.5% Mg and 1 to 3.5% Cu;

(b) 2XXX alloys containing about 3.8 to 6% Cu and one or more of about 0.2 to 1% Mn and about 0.3 to 3% Mg; and (c) 6XXX alloys containing about 0.2 to 2% Si and about 0.3 to 2% Mg, said alloy further containing about 0.1 to 0.7% scandium and about 0.05 to about 0.2% zirconium.

11. In the method according to claim 8 wherein said alloy contains about 4 to 10% zinc, about 1 to 3.5% magnesium, about 1 to 3.5% copper, about 0.1 to 0.7% scandium, and about 0.07 to 0.2% zirconium.

12. In a method according to claim 8 wherein said alloy contains 5.5 to 7.1% zinc, about 1.8 to 2.8% magnesium, about 1.8 to 2.8% copper, about 0.07 to about 0.2% zirconium, and about 0.1 to 0.7% scandium.

13. An improved superplastically formed article of manufacture comprising a heat treatable 2XXX, 6XXX or 7XXX aluminum alloy, said alloy further containing about 0.05 to 1% scandium and about 0.05 to 0.25% zirconium.

14. The improved superplastically formed article according to claim 13 wherein said alloy is selected from:

(a) 7XXX alloys containing about 4 to 10% Zn, 1 to 3.5% Mg and 1 to 3.5% Cu;

(b) 2XXX alloys containing about 3.8 to 6% Cu and one or more of about 0.2 to 1% Mn and about 0.3 to 3% Mg; and (c) 6XXX alloys containing about 0.2 to 2% Si and about 0.3 to 2% Mg, said alloy further containing about 0.1 to 0.7% scandium and about 0.05 to about 0.2% zirconium.

15. The improved superplastically formed article according to claim 13 wherein said alloy contains about 4 to 10% zinc, about 1 to 3.5% magnesium, about 1 to 3.5% copper, about 0.1 to 1% scandium, and about 0.05 to 0.25% zirconium.

16. The improved superplastically formed article according to claim 13 wherein said alloy contains about 5.5 to 7.1% zinc, about 1.8 to 2.8% magnesium, about 1.8 to 2.8% copper, about 0.07 to about 0.2% zirconium, and about 0.1 to 0.7% scandium.

17. In a method of superplastic forming wherein aluminum alloy metal is superplastically formed at superplastic forming temperature, the improvement comprising: providing said aluminum alloy comprising a heat treatable aluminum alloy containing about 5.5 to 7.1% Zn, about 1.8 to 2.8% Mg, about 1.8 to 2.8% Cu, about 0.05 to 1% Sc and about 0.05 to 0.25% Zr.

18. In a method of superplastic forming wherein aluminum alloy metal is superplastically formed at superplastic forming temperature, the improvement comprising: providing said aluminum alloy comprising a heat treatable aluminum alloy containing about 4 to 10% Zn, about 1 to 3.5% Mg, about 1 to 3.5% Cu, about 0.1 to 1% Sc, and about 0.05 to 0.25% Zr.

19. In a method of superplastic forming wherein aluminum alloy metal is superplastically formed at superplastic forming temperature, the improvement comprising: providing said aluminum alloy comprising a heat treatable aluminum alloy containing about 3.8 to 6% Cu and one or more of about 0.2 to 1% Mn and about 0.3 to 3% Mg.

20. The method according to claim 1 wherein the superplastic forming of said aluminum alloy metal includes forging.

21. The method according to claim 8 wherein the superplastic forming of said aluminum alloy metal includes forging.

22. The method according to claim 10 wherein the superplastic forming of said aluminum alloy metal includes forging.

23. The method according to claim 18 wherein the superplastic forming of said aluminum alloy metal includes forging.

24. The method according to claim 19 wherein the superplastic forming of said aluminum alloy metal includes forging.

25. The article according to claim 4, the manufacture of which includes forging.

26. The article according to claim 5, the manufacture of which includes forging.

27. The article according to claim 13, the manufacture of which includes forging.

28. The article according to claim 14, the manufacture of which includes forging.

29. The article according to claim 15, the manufacture of which includes forging.

30. The article according to claim 16, the manufacture of which includes forging.

* * * * *

UNITED STATES PATENT AND TRADEMARK OFFICE

CERTIFICATE OF CORRECTION

PATENT NO. : 5,055,257

DATED : October 8, 1991

INVENTOR(S) : Dhruba J. Chakrabarti, James T. Staley, Stephen F. Baumann, Ralph R. Sawtell, Philip E. Bretz, Craig L. Jensen It is certified that error appears in the above-identified patent and that said Letters Patent is hereby corrected as shown below:

| | |
|---|---|
| Col. 8, line 1 | After "may", change "the" to --be-- |
| Col. 8, line 52 | Change "$Al_{13}$" to --$Al_3$-- |
| Col. 8, line 64 | Change "scahdium" to --scandium-- |
| Col. 8, line 64 | Change "X" to --X'-- |
| Col. 10, line 35 (1st occurrence) | After "exceed", insert --7%,-- |
| Col. 10, line 36 | After "3% or", insert --4%-- |
| Col. 16, line 2 (Claim 8) | After "alloy", delete --stock-- |

Signed and Sealed this

Nineteenth Day of January, 1993

*Attest:*

*Attesting Officer*

DOUGLAS B. COMER

*Acting Commissioner of Patents and Trademarks*